US009109421B2

(12) United States Patent
Carbaugh et al.

(10) Patent No.: US 9,109,421 B2
(45) Date of Patent: Aug. 18, 2015

(54) DEFORMATION RESISTANT OPENING CHAMBER HEAD AND METHOD

(75) Inventors: William L. Carbaugh, Humble, TX (US); Leonard G. Childers, Houston, TX (US); Eric Mei, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 1136 days.

(21) Appl. No.: 12/338,556

(22) Filed: Dec. 18, 2008

(65) Prior Publication Data

US 2010/0155628 A1 Jun. 24, 2010

(51) Int. Cl.
*E21B 33/06* (2006.01)

(52) U.S. Cl.
CPC ..... *E21B 33/06* (2013.01)

(58) Field of Classification Search
CPC ..... E21B 33/06; E21B 33/085; E21B 33/062; E21B 34/16; E21B 33/064; E21B 33/061; E21B 33/063; E21B 33/08; E21B 33/03
USPC ..... 251/1.2, 1.1; 166/85.4
See application file for complete search history.

(56) References Cited

U.S. PATENT DOCUMENTS

| | | | | |
|---|---|---|---|---|
| 2,609,836 | A | | 9/1952 | Knox |
| 3,572,627 | A | | 3/1971 | Jones et al. |
| 4,099,699 | A | | 7/1978 | Allen |
| 4,317,557 | A | | 3/1982 | Orr |
| 4,447,037 | A | | 5/1984 | Huey et al. |
| 4,458,876 | A | * | 7/1984 | Schaeper et al. ..... 251/1.2 |
| 4,460,151 | A | | 7/1984 | Williams, III et al. |
| 4,602,794 | A | * | 7/1986 | Schaeper et al. ..... 277/327 |
| 4,614,148 | A | * | 9/1986 | Bates ..... 91/420 |
| 4,858,882 | A | * | 8/1989 | Beard et al. ..... 251/1.2 |
| 5,012,854 | A | * | 5/1991 | Bond ..... 166/363 |
| 5,361,832 | A | * | 11/1994 | Van Winkle ..... 166/84.4 |
| 5,575,452 | A | | 11/1996 | Whitby et al. |
| 5,653,418 | A | | 8/1997 | Olson |
| 7,159,669 | B2 | | 1/2007 | Bourgoyne et al. |
| 2008/0142746 | A1 | | 6/2008 | Hemphill et al. |

FOREIGN PATENT DOCUMENTS

| | | | |
|---|---|---|---|
| CN | 2522614 | Y | 11/2002 |
| CN | 2551758 | Y | 5/2003 |
| CN | 201090170 | Y | 7/2008 |
| EP | 0413428 | | 2/1991 |
| JP | 48006362 | B1 | 2/1973 |
| JP | 58120989 | A | 7/1983 |
| WO | WO 2004059118 | | 7/2004 |

(Continued)

OTHER PUBLICATIONS

JP Notice of Allowance dated Nov. 12, 2013 from corresponding Application No. 2009-285851.

(Continued)

*Primary Examiner* — Ryan Reis
*Assistant Examiner* — Chee-Chong Lee
(74) *Attorney, Agent, or Firm* — Bracewell & Giuliani LLP

(57) ABSTRACT

An annular blowout preventer device includes a body and a static head removably connected to the body, A piston is disposed inside an opening chamber to squeeze a packer. An opening chamber head has a rib extending upward from an upper surface. The rib is received within a recess in the lower surface of the static head.

17 Claims, 7 Drawing Sheets

(56) References Cited

FOREIGN PATENT DOCUMENTS

| | | | |
|---|---|---|---|
| WO | 2008014514 | A1 | 1/2008 |
| WO | 2008014517 | A1 | 1/2008 |
| WO | WO 2008039589 | | 4/2008 |
| WO | 2008097666 | A1 | 8/2008 |
| WO | WO 2008101005 | | 8/2008 |

OTHER PUBLICATIONS

CN Office Action dated Aug. 2, 2013 from corresponding CN Application No. 200910265921.X.

* cited by examiner

DEFORMATION RESISTANT OPENING CHAMBER HEAD AND METHOD

BACKGROUND

1. Technical Field

Embodiments of the subject matter disclosed herein generally relate to blowout preventers and an opening chamber head that are configured to withstand deformations created by high pressures.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

The existing technologies for extracting the fossil fuel from offshore fields use a system 10 as shown in FIG. 1. More specifically, the system 10 includes a vessel 12 having a reel 14 that supplies power/communication cords 16 to a controller 18. A reel may be used to transmit power and communication. Some systems have hose reels to transmit fluid under pressure or hard pipe (rigid conduit) to transmit the fluid under pressure or both. Other systems may have a hose with communication or lines (pilot) to supply and operate functions subsea. However, a common feature of these systems is their limited operation depth. The controller 18, which will be discussed later, is disposed undersea, close to or on the seabed 20. In this respect, it is noted that the elements shown in the figures are not drawn to scale and no dimensions should be inferred from the figures.

FIG. 1 also shows a wellhead 22 of the subsea well and a production tubing 24 that enters the subsea well. At the end of the production tubing 24 there is a drill (not shown). Various mechanisms, also not shown, are employed to rotate the production tubing 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to a "kick" or a "blowout" and may occur when formation pressure exceeds the pressure applied to it by the column of drilling fluid. This event is unforeseeable and if no measures are taken to prevent it, the well and/or the associated equipment may be damaged.

Another event that may damage the well and/or the associated equipment is a hurricane or an earthquake. Both of these natural phenomena may damage the integrity of the well and the associated equipment. For example, due to the high winds produced by a hurricane at the surface of the sea, the vessel or the rig that powers the undersea equipment starts to drift resulting in breaking the power/communication cords or other elements that connect the well to the vessel or rig. Other events that may damage the integrity of the well and/or associated equipment are possible as would be appreciated by those skilled in the art.

Thus, a blowout preventer (BOP), later to be expressed as BOP only, might be installed on top of the well to seal it in case that one of the above events is threatening the integrity of the well. The BOP is conventionally implemented as a valve to prevent the release of pressure either in the annular space between the casing and the drill pipe or in the open hole (i,e., hole with no drill pipe) during drilling or completion operations. FIG. 1 shows BOPs 26 or 28 that are controlled by the controller 18. The blowout preventer controller 18 controls an accumulator 30 to close or open BOPs 26 and 28. More specifically, the controller 18 controls a system of valves for opening and closing the BOPs. Hydraulic fluid, which is used to open and close the valves, is commonly pressurized by equipment on the surface. The pressurized fluid is stored in accumulators on the surface and subsea to operate the BOPs. The fluid stored subsea in accumulators may also be used to autoshear and/or for deadman functions when the control of the well is lost. The accumulator 30 may include containers (canisters) that store the hydraulic fluid under pressure and provide the necessary pressure to open and close the BOPs. The pressure from the accumulator 30 is carried by pipe or hose 32 to BOPs 26 and 28.

One type of BOP is the annular blowout preventer, an example of which is shown in FIG. 2. The annular BOP 26 has a body 40 in which is formed a cavity 42. The drill line (not shown) crosses through the cavity 42. The annular BOP 26 is attached to the well head 22 via a flange 44. A packer 46 is formed inside the cavity 42 of the body 40, around the drill line so that the packer 46 does not affect the movement of the drill line when the BOP is open. A static head 48 is attached to the body 40 to close the cavity 42 and also to prevent the packer 46 to exit the body 40. A piston 50 is provided in a recess of the body 40 to not affect the movement of the drill line through the cavity 42. The piston 50 is shown in FIG. 2 not pressing on the packer 46.

However, when piston 50 is actuated by the high pressure from the accumulator 30, the piston 50 moves towards the packer 46, squeezing the packer 46 such that a portion of the packer 46 presses against the drill line and seals the well. When the piston 50 moves upward, an opening chamber 52 decreases in size until an upper tip of piston 50 touches or is close to touch an opening chamber head 60. The closing pressure that actuates the piston 50 enters the closing chamber 58 (shown in FIG. 3) via an inlet 54. Once the piston 50 is closed, the high pressure from the closing chamber 58 is vented out so that the piston 50 is prepared for the opening phase. At this stage, it was observed that the piston 50 may move downwards, resulting in the occurrence of a low pressure or vacuum on a lower part A of the opening chamber head 60 while a high pressure (from sea water for example) may appear on an upper part B of the opening chamber head 60 as shown in FIG. 3.

FIG. 3 shows in more details the opening chamber head 60 being in contact with the static head 48, the piston 50 and the body 40. The opening chamber head 60 has a recess 62 in which o-rings are placed to seal the opening chamber 52. Due to the vacuum that occurs when the piston 50 moves backwards after the piston 50 was closed, it was observed that the opening chamber head 60 deforms due to the high pressure difference between sides A and B. As the opening chamber head 60 ensures that the hydraulic liquid in the opening chamber 52 remains free of contamination from outside, the deformation of the opening chamber head 60 is undesired as it reduces the time interval between scheduled maintenance events, increases the maintenance cost, and also increases the down time of the rig.

Accordingly, it would be desirable to provide systems and methods that avoid the afore-described problems and drawbacks.

SUMMARY

According to one exemplary embodiment, there is an annular blowout preventer device including a body having a first cavity extending from a first end to a second end, the first cavity being configured to accommodate a drill line; a static head removably connected to the first end of the body and having a second cavity that is aligned with the first cavity of the body to accommodate the drill line; a piston disposed inside the first and second cavities to define an opening chamber and a closing chamber together with the static head and the body, the piston being configured to move inside the first and second cavities to squeeze a packer for sealing the first cavity from the second cavity; and an opening chamber head disposed in the opening chamber next to the static head, the body, and the piston, the opening chamber head being configured to protect a hydraulic fluid in the opening chamber from external contamination. The opening chamber head has a body having a circular shape with an inside hole, the body having a cross section along a radial direction having at least three parts, a body part having a rectangular shape, a first rib extending from a longest side of the body part, the first rib overlaying a median line of the body part, wherein the median line is substantially perpendicular to the longest side of the body part, and a second rib extending from the longest side of the body part, on the same side as the first rib, the second rib being closer to a shortest side of the body part than to the median.

According to another exemplary embodiment, there is an opening chamber head including a body having a circular shape with an inside hole, the body having a cross section along a radial direction having at least three parts, a body part having a rectangular shape, a first rib extending from a longest side of the body part, the first rib overlaying a median line of the body part, wherein the median line is substantially perpendicular to the longest side of the body part, and a second rib extending from the longest side of the body part, on the same side as the first rib, the second rib being closer to a shortest side of the body part than to the median.

According to still another exemplary embodiment, there is a method for preventing a deformation of an opening chamber head in an annular blowout preventer when exposing the opening chamber head to a high pressure difference, the blowout preventer having a body with a first cavity extending from a first end to a second end, the first cavity being configured to accommodate a drill line, a static head removably connected to the first end of the body and having a second cavity that is aligned with the first cavity of the body to accommodate the drill line, a piston disposed inside the first and second cavities to define an opening chamber and a closing chamber together with the static head and the body, the piston being configured to move inside the first and second cavities to squeeze a packer for sealing the first cavity from the second cavity, and the opening chamber head disposed in the opening chamber in contact with the static head, the body, and the piston. The method includes closing the piston by applying a pressure to the closing chamber; venting the closing chamber while the piston is closed such that the piston moves backwards and creates vacuum inside the opening chamber, between the piston and the opening chamber head; experiencing a high pressure on the opening chamber head, from outside the opening chamber such that a large pressure difference is exerted on the opening chamber head; and maintaining an original shape of the opening chamber head by providing the opening chamber head to have a body having a circular shape with an inside hole, the body having a cross section on a radial direction having at least three parts, a body part having a rectangular shape, a first rib extending from a longest side of the body part, the first rib overlaying a median line of the body part, wherein the median line is substantially perpendicular to the longest side of the body part, and a second rib extending from the longest side of the body part, on the same side as the first rib, the second rib being closer to a shortest side of the body part than to the median.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of annular BOP systems. However, the embodiments to be discussed next are not limited to these systems.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a novel opening chamber head 60, having features that will be described next, is provided such that the occurrence of vacuum on one side of the opening chamber head 60 and a high pressure on the other side does not deform the opening chamber head 60.

Figure 5:
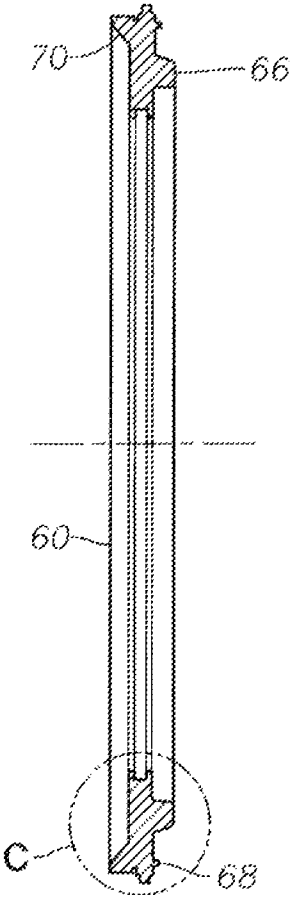
FIG. 5 is a sectional view taken along the line 5-5 of FIG. 4 of he opening chamber head according to an exemplary embodiment.
Figure 4:
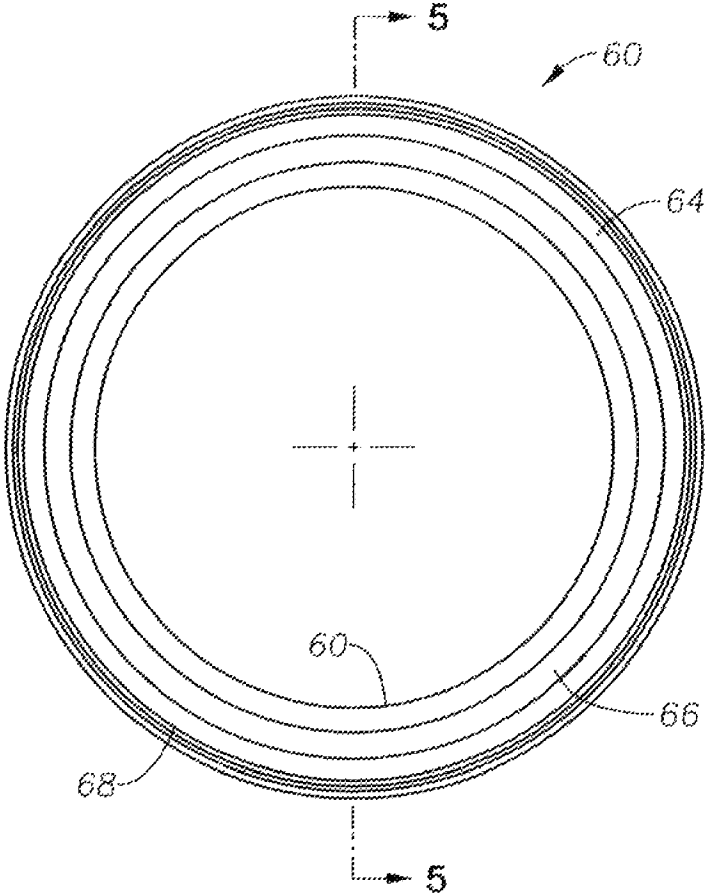
FIG. 4 is a top view of an opening chamber head according to an exemplary embodiment.

FIG. 4 shows a top view of the opening chamber head 60 while FIG. 5 shows a cross section of the opening chamber head 60. The opening chamber head 60 may be a ring. The circled portion C of the cross section of the opening chamber head 60 is shown exploded in FIG. 6. As will be recognized by one of ordinary skill in the art, the opening chamber head 60 is empty in the middle as FIG. 5 shows that only an upper part and a lower part make up the opening chamber head 60.

With regard to FIG. 6, the cross section of the opening chamber head 60 may be divided into a body part 64 of the opening chamber head 60 and other smaller parts that are discussed next. According to an exemplary embodiment, the body part 64 of the opening chamber head 60 is rectangular. Other shapes are possible for the body part 64 of the opening chamber head 60. From the body part 64 of the head opening chamber 60, at least two ribs 66 and 68 extend on a same side D of the body part 64.

According to an exemplary embodiment, the first rib 66 is larger than the second rib 68. For example, the first rib 66 is longer in a direction X and also in a direction Y than the second rib 68. The first rib 66 may be placed, in one application, to overlay a center line F of the body part 64, where the center line F divides the body part 64 in two halves. In one application, a surface of the body part 64, between the first rib 66 and the second rib 68 is flat. In another application, a surface 60*a* of the opening chamber head 60 is disposed substantially parallel to a surface 64*a* of the body 64 but shifted along the X axis relative to surface 60*a*. In still another application, a tip of the second rib 68 is aligned, on the X axis, with the surface 60*a*. In another application, a height of the first rib 66 along the X axis is larger thant a width of the body part 64 along the same axis and a height of the second rib 68 along the X axis is smaller than the width of the body part 64 along the same axis.

According to an exemplary embodiment, the second rib 68 may be placed closer to an end G of the opening chamber head 60 than the center line F. In one application, the second rib 68 may be placed to be aligned with the recess 62, as shown in FIG. 6. The first and second ribs 66 and 68 may be formed of the same material as the body part 64. One of the known methods of forging, molding, machining, etc., may be used to form the opening chamber head 60 having the first and second ribs 66 and 68.

Although a size of the existing opening chamber heads has been increased along direction F to prevent the deformation discussed above, the deformation still occurred in those heads. However, the arrangement shown in FIG. 6, with the first and second ribs 66 and 68 formed at the positions discussed above, exhibits unexpected results in terms of strength and resistance to deformation. It is believed that the first rib 66 and second rib 68 impart strength characteristics to the opening chamber head 60 at a deformation point.

Figure 6:
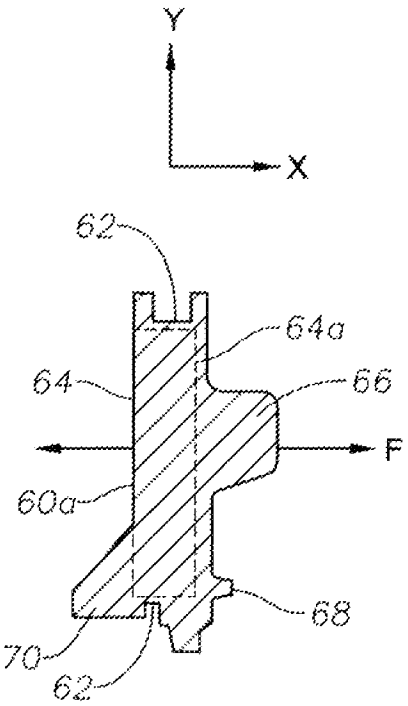
FIG. 6 is a cross sectional view of the opening chamber head according to an exemplary embodiment.

The cross section of the opening chamber head 60 shown in FIG. 6 includes two recesses 62 configured to accommodate corresponding rubber rings. These rubber rings press against the piston 50 and the body 40 of the annular BOP 26 for sealing the opening chamber 52. According to an exemplary embodiment, the recess facing the piston 50 is wider than the recess facing the body 40 of the annular BOP 26.

The opening chamber head 60 shown in FIG. 6 may have a third rib 70 formed at the end G of the opening chamber bead 60 such that the third rib 70 borders the narrow recess 62. In one application, the third rib 70 has a triangular like shape, with the longest catheti (leg) facing the body part 64 of the opening chamber head 60, the shortest catheti (leg) facing the body 40 of the annular BOP 26 and the hypotenuse facing the opening chamber 52. This arrangement of the third rib 70 prevents the opening chamber head 60 from tilting towards the body 40 of the annular B0P 26 when a high pressure is applied on the D side of the opening chamber head 60 and vacuum is exerted on the E face of the opening chamber head 60.

One skilled in the art would appreciate that high pressures in the context of the annular BOP might be as high as 4000 psi above the ambient pressure, which itself may be around 4000 psi undersea. Thus, the novel structure of the opening chamber head 60 discussed with regard to FIG. 6 has to be considered in the context of blowout preventers used for extracting oil or gas from various wells at high pressures.

Figure 1:
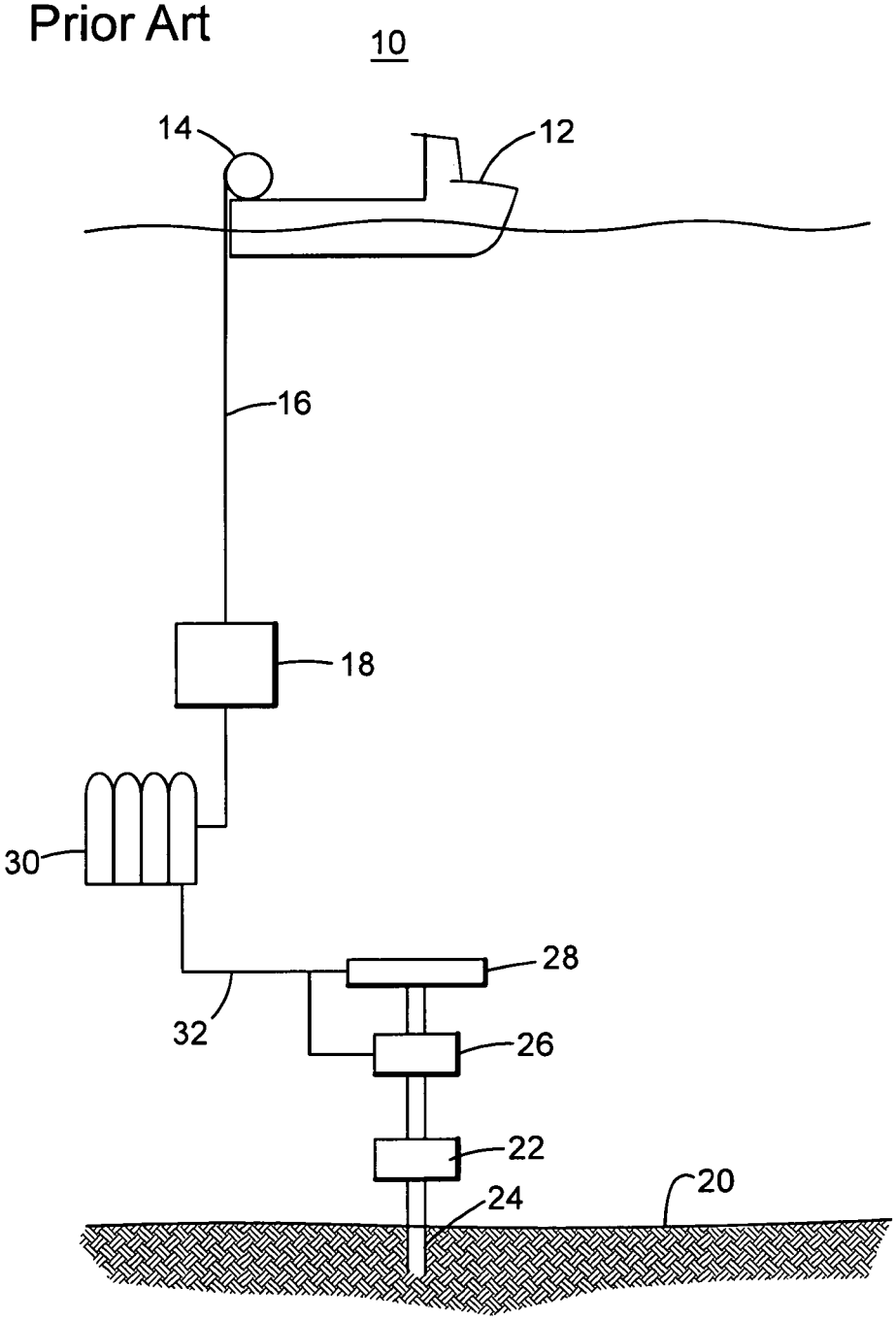
FIG. 1 Prior Art
FIG. 1 is a schematic diagram of a conventional offshore rig.
Figure 2:
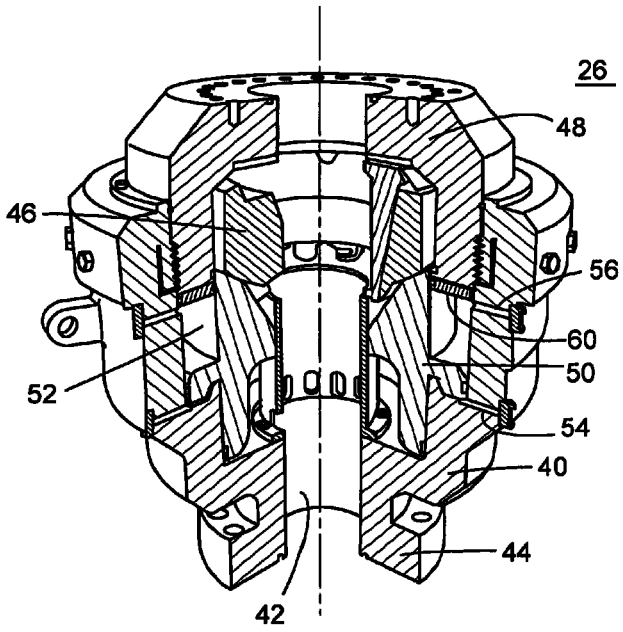
FIG. 2 Prior Art
FIG. 2 is a schematic diagram of a annular BOP.
Figure 3:
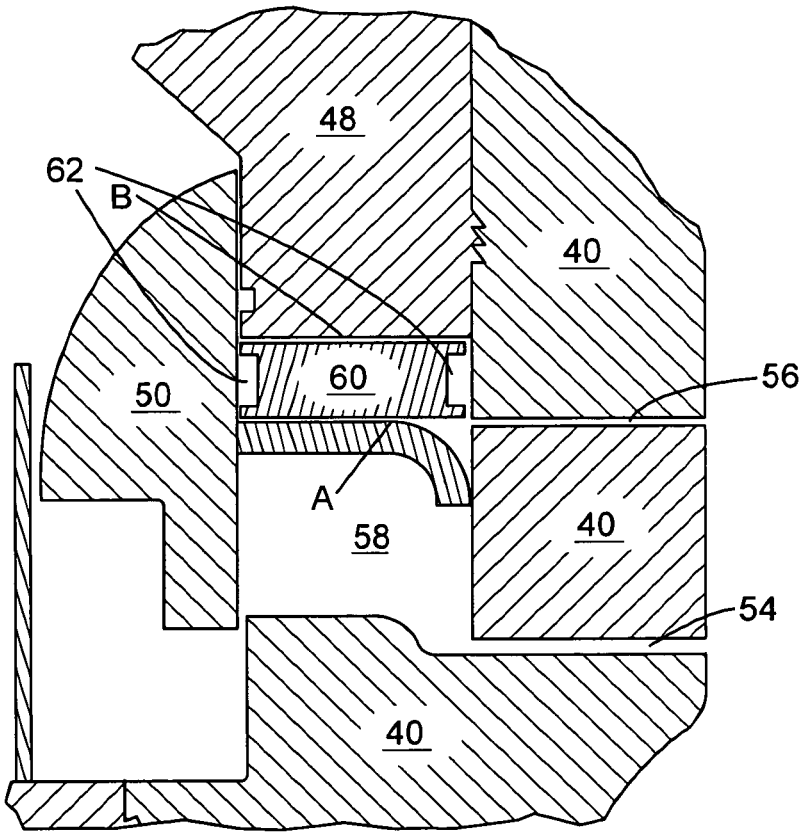
FIG. 3 Prior Art
FIG. 3 is a schematic diagram of an opening chamber head of the annular BOP.
Figure 7:
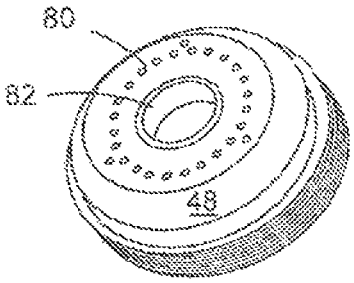
FIG. 7 is an overall view of a static head according to an exemplary embodiment.

As the opening chamber head 60 is disposed next to the static head 48 shown in FIGS. 2 and 3, the static head 48 may, according to an exemplary embodiment, be configured to match the profile of the opening chamber head 60. FIG. 7 shows an overview of the static head 48 having plural holes 80 in top of the static head 48 through which screws are inserted for fixing the static head 48 to the body 40 of the annular BOP 26. The head 48 also includes a large hole 82 through which the drilling pipe is inserted.

Figure 8:
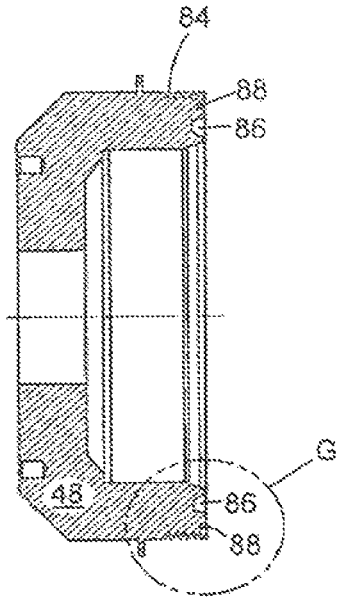
FIG. 8 is a cross sectional view of the static head according to an exemplary embodiment.

FIG. 8 shows a cross section through the static head 48. FIG. 8 shows a side of the static head 48 having a non flat surface 84. Although this surface 84 appears to be threaded, that is not the case. The surface 84 is designed to maintain the static head 48 fixed to the body 40 of the annular BOP 26. The static head 48 defines a cavity through which the drill line passes. A region G of the static head 48 is shown in more details in FIG. 9. The region G shown in FIG. 8 has a symmetric corresponding region on the body 40.

Figure 9:
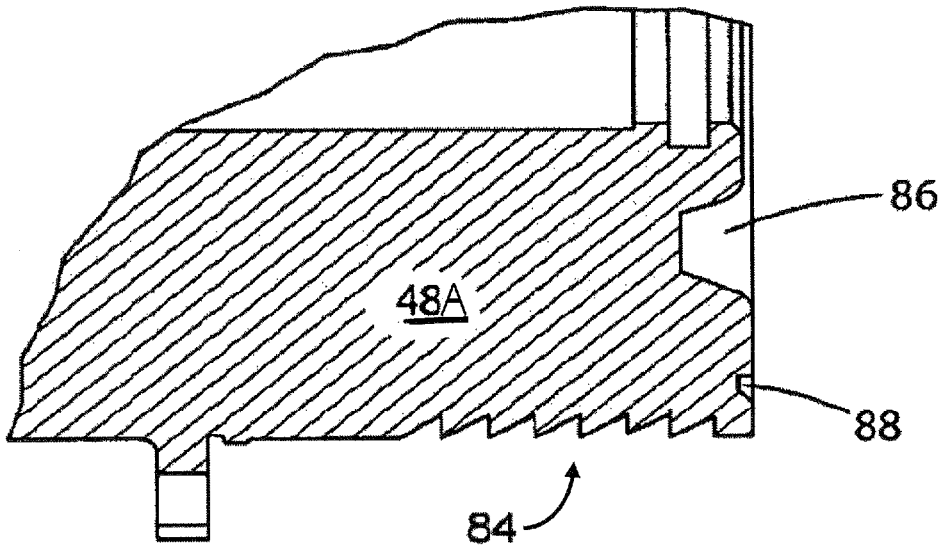
FIG. 9 is a detailed cross section view of an alternate embodiment of the portion within the circle G of the static head of FIG. 8.

With regard to FIG. 9, an alternate embodiment of the static head body 48A is shown and has two recesses 86 and 88 that correspond to the first and second ribs 66 and 68, respectively. In one application, a face of region G in FIG. 8, which receives the first and second ribs of the opening chamber head 60, is shaped to match the D side of the opening chamber head 60 shown in FIG. 6. In this way, the opening chamber head 60 joins the static head 48A without screws or other fixing means. Further, as discussed above, a portion of surface 84 is profiled with ridges. Also in the embodiment of the static head 48A of FIG. 9, provided on surface 84 is a flange having an axial bore.

Figure 10:
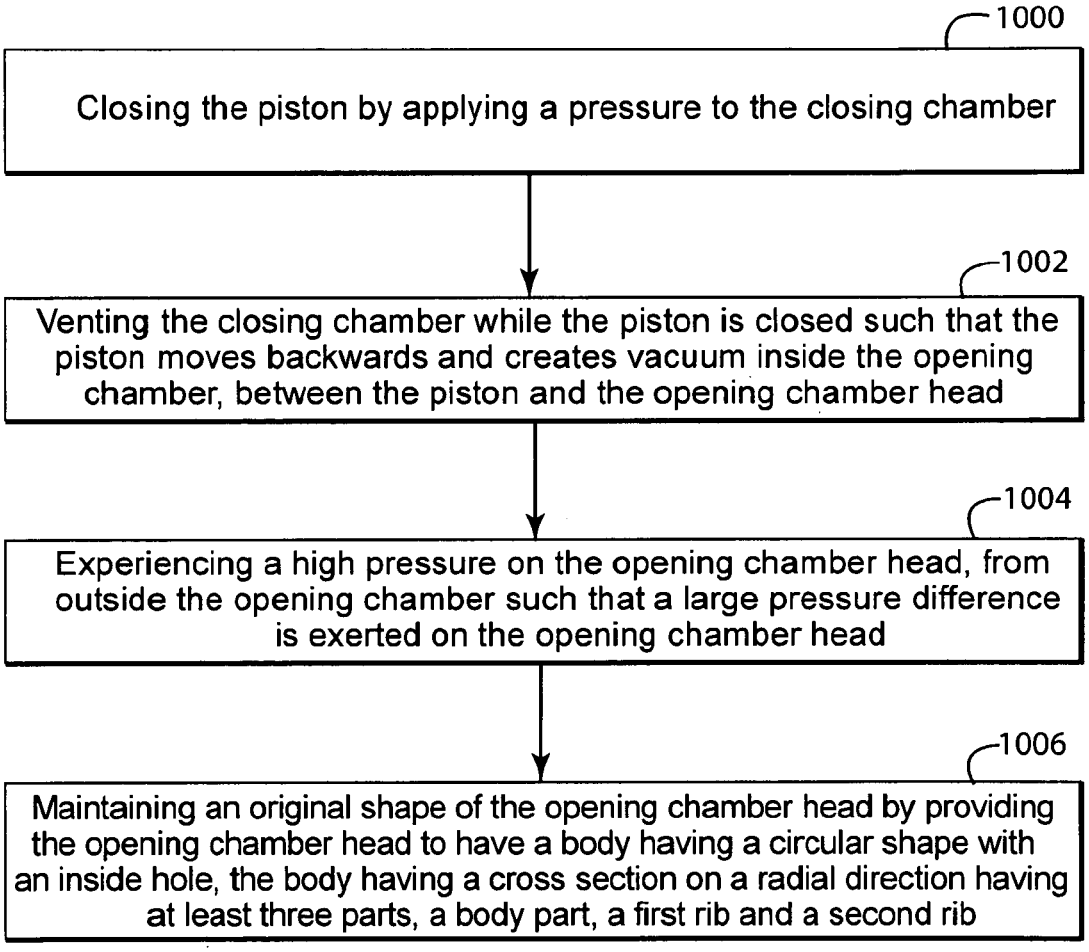
FIG. 10 is a flow diagram illustrating steps for using the opening chamber head in an annular BOP.

According to an exemplary embodiment, FIG. 10 illustrates the steps of a method for preventing a deformation of an opening chamber head in an annular blowout preventer when exposing the opening chamber head to a high pressure difference, the blowout preventer having a body with a first cavity extending from a first end to a second end, the first cavity being configured to accommodate a drill line, a static head removably connected to the first end of the body and having a second cavity that is aligned with the first cavity of the body to accommodate the drill line, a piston disposed inside the first and second cavities to define an opening chamber and a closing chamber together with the static head and the body, the piston being configured to move inside the first and second cavities to squeeze a packer for sealing the first cavity from the second cavity, and the opening chamber head disposed in the opening chamber in contact with the static head, the body, and the piston. The method includes a step 1000 of closing the piston by applying a pressure to the closing chamber; a step 1002 of venting the closing chamber while the piston is closed such that the piston moves backwards and creates vacuum inside the opening chamber, between the piston and the opening chamber head; a step 1004 of experiencing a high pressure on the opening chamber head, from outside the opening chamber such that a large pressure difference is exerted on the opening chamber head; and a step 1006 of maintaining an original shape of the opening chamber head by providing the opening chamber head to have a body having a circular shape with an inside hole, the body having a cross section on a radial direction having at least three parts. The three parts are a body part having a rectangular shape, a first rib extending from a longest side of the body part, the first rib overlaying a median line of the body part, wherein the median line is substantially perpendicular to the longest side of the body part, and a second rib extending from the longest side of the body part, on the same side as the first rib, the second rib being closer to a shortest side of the body part than to the median.

The disclosed exemplary embodiments provide a system and a method for preventing an opening chamber head from deforming while closing and opening the annular BOP. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements with insubstantial differences from the literal languages of the claims.

What is claimed is:

1. A blowout preventer, comprising:

a body having a bore with an axis for the passage of a well pipe;

a static head that secures to an upper end of the body;

an annular opening chamber in the body;

an annular piston having an outer portion carried in the opening chamber for axial movement, the piston having an inner portion that defines an inner wall of the opening chamber;

an annular packer element carried in the bore and engageable by the inner portion of the piston as the piston moves upward for closing around the well pipe;

an opening chamber head located in the opening chamber above the outer portion of the piston and circumscribing the inner portion of the piston, the opening chamber head having an outer portion in sealing engagement with an inner surface of the body and an inner portion in sliding and sealing engagement with an outer surface of the inner; portion of the piston, the opening chamber head having an upper surface with at least one annular rib protruding upwardly therefrom, the opening chamber head having a lower surface that is abutted by the outer portion of the piston while the piston is in an upper position;

the static head having a lowermost surface located in a plane perpendicular to the axis, the lowermost surface having at least one annular recess into which the at least one annular rib extends, the at least one annular recess having concentric inner and outer walls extending upwardly from the lowermost surface of the static head, the at least one annular rib extending between and in engagement with the pair of concentric walls such that the pair of concentric walls are operable to provide lateral support on inner and outer sides of the at least one annular rib;

the lower surface of the opening chamber head has a downward and outward extending conical surface with a lowermost portion that terminates adjacent the outer portion of the opening chamber head; and the outer portion of the piston has an upper surface with a downward and outward extending conical surface that terminates adjacent an outer surface of the outer portion of the piston for mating with the conical surface on the lower surface of the opening chamber head.

2. The blowout preventer according to claim 1, wherein:

said at least one annular rib comprises an inner rib and an outer rib concentric with each other, each protruding upward from the upper surface of the opening chamber head, the inner rib being closer to the axis than the outer rib and having a greater height than the outer rib; and said at least one annular recess comprises an inner recess and an outer recess receiving the inner rib and the outer rib, respectively, each of the inner recess and the outer recess having concentric inner and outer walls.

3. The blowout preventer according to claim 2, wherein:

the inner rib has a greater radial thickness than the outer rib; and the inner recess has a greater radial width than the outer recess.

4. The blowout preventer according to claim 1, wherein:

the at least one annular rib has an inner wall, an outer wall, and an upper surface; and at least one of the walls of the at least one annular rib is a conical surface that inclines from the upper surface of the opening chamber head to the upper surface of the rib.

5. The blowout preventer according to claim 1, wherein:

the at least one annular rib has an inner wall, an outer wall, and an upper surface; and the outer wall of the at least one annular rib is a conical surface that inclines inward from the upper surface of the opening chamber head to the upper surface of the rib.

6. The blowout preventer according to claim 1, wherein:

the at least one annular rib has an inner wall, an outer wall, and an upper surface;

the outer wall of the at least one annular rib is a conical surface that inclines inward from the upper surface of the opening chamber head to the upper surface of the rib; and the inner wall of the at least one annular rib is cylindrical.

7. The blowout preventer according to claim 1, wherein:

said at least one annular rib comprises an inner rib and an outer rib concentric with each other, each protruding upward from the upper surface of the opening chamber head, the inner rib being closer to the axis than the outer rib; and a centerline equidistant between the inner and outer portions of the opening chamber head and parallel to the axis passes through the inner rib.

8. The blowout preventer according to claim 1, wherein:

said at least one annular rib comprises an inner rib and an outer rib concentric with each other, each protruding upward from the upper surface of the opening chamber head, the inner rib being a closer radial distance to the axis than a radial distance from the axis to the outer rib; and said at least one annular recess comprises an inner recess and an outer recess receiving the inner rib and the outer rib, respectively, each of the inner and outer recesses having concentric walls, the inner recess having a greater depth than the outer recess.

9. A blowout preventer, comprising:

a body having a bore with an axis for the passage of well pipe;

a static head that secures to an upper end of the body, the static head and the body defining an annular opening chamber;

a piston having an outer portion carried in the opening chamber for axial movement, the piston having an inner portion that defines an inner wall of the opening chamber;

a packer element located above the piston and surrounding the bore for inward deformation into engagement with the well pipe in response to upward movement of the piston;

an opening chamber head located at an upper end of the opening chamber above the outer portion of the piston and circumscribing the inner portion of the piston, the opening chamber head having an outer portion in sealing engagement with an inner surface of body and an inner portion in sliding and sealing engagement with an outer surface of the inner portion of the piston, the opening chamber head having a lower surface abutted by the outer portion of the piston while the piston is in an upper position;

an annular inner rib protruding upwardly from an upper surface of the opening chamber head, the inner rib having an inner side and an outer side;

an annular outer rib protruding upwardly from the upper surface of the opening chamber head a lesser height than the inner rib, the outer rib being farther from the axis than the inner rib, the outer rib having an inner side and an outer side; and annular inner and outer recesses formed in a lower surface of the static head into which the inner and outer ribs, respectively, extend, the annular inner and outer recess each including a pair of concentric walls extending upwardly from the lower surface of the static head such that each of the pairs of concentric walls are operable to provide lateral support on the inner and outer sides of the respective rib extending therebetween.

10. The blowout preventer according to claim 9, wherein:

the inner rib has a greater radial thickness than the outer rib.

11. The blowout preventer according to claim 9, wherein:

the outer side of the inner rib is inclined inwardly from the upper surface of the opening chamber head to an upper surface of the inner rib.

12. The blowout preventer according to claim 11, wherein the inner side of the inner rib is cylindrical.

13. The blowout preventer according to claim 9, wherein:

one of the inner and outer sides of each of the inner and outer ribs is conical.

14. The blowout preventer according to claim 9, further comprising:

the lower surface of the opening chamber head has a downward and outward extending conical surface with a lowermost portion that terminates adjacent the outer portion of the opening chamber head; and the outer portion of the piston has a downward and outward extending conical surface that terminates adjacent an outer surface of the outer portion of the piston for mating with the conical surface on the lower surface of the opening chamber head.

15. A blowout preventer, comprising:

a body having a bore with an axis for the passage of well pipe;

a static head that secures to an upper end of the body, the static head and the body defining an annular opening chamber, the static head having a lowermost surface located in a plane perpendicular to the axis;

a piston having an outer portion carried in the opening chamber for axial movement, the piston having an inner portion that defines an inner wall of the opening chamber;

an annular packer surrounding the bore above the inner portion of the piston for inward deformation around the well pipe in response to upward movement of the piston;

an opening chamber head located at an upper end of the opening chamber above the outer portion of the piston, the opening chamber head having an outer portion that sealingly engages an inner surface of body, and an inner portion in sliding and sealing engagement with an outer circumference of the inner portion of the piston, the opening chamber head having a lower surface abutted by the outer portion of the piston while the piston is in an upper position;

an annular inner rib protruding upwardly from an upper surface of the opening chamber head, the inner rib having an inner wall and an outer wall, each of the inner and outer walls of the inner rib extending to an upper surface of the inner rib, at least one of the inner and outer walls of the inner rib being conical;

an annular outer rib protruding upward from the upper surface of the opening chamber head a greater distance to the axis than the inner rib, the outer rib having an upper surface with a lesser radial thickness than a radial thickness of the upper surface of the inner rib, the outer rib being concentric with the inner rib, the outer rib having an inner wall and an outer wall extending to the upper surface of the inner rib, at least one of the inner and outer walls of the outer rib being conical; and annular inner and outer recesses formed in the lowermost surface of the static head and having mating surfaces that receive the inner and outer ribs, respectively, the annular inner and outer recesses each including concentric inner and outer walls extending upwardly from the lowermost surface of the static head, at least one of the inner and outer walls of the inner and outer recesses being conical, the inner and outer walls of the inner and outer recesses mating and in contact with the inner and outer walls of the inner and outer ribs, respectively to provide lateral support to the inner and outer ribs.

16. The blowout preventer according to claim 15, wherein:

the outer wall of the inner rib is conical; and the outer wall of the outer rib is conical.

17. The blowout preventer according to claim 15, wherein:

the lower surface of the opening chamber head has a downward and outward extending conical surface with a lowermost portion that terminates adjacent the outer portion of the opening chamber head; and the outer portion of the piston has an upper surface with a downward and outward extending conical surface that terminates adjacent an outer surface of the outer portion of the piston for mating with the conical surface on the lower surface of the opening chamber head.

* * * * *